US008678787B2

(12) United States Patent
Hirata et al.

(10) Patent No.: US 8,678,787 B2
(45) **Date of Patent: *Mar. 25, 2014**

(54) PIEZOELECTRIC MICRO-BLOWER

(75) Inventors: Atsuhiko Hirata, Yasu (JP); Gaku Kamitani, Kyoto (JP); Hiroaki Wada, Oumihachiman (JP); Midori Sunaga, Higashioumi (JP); Shungo Kanai, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 700 days.

This patent is subject to a terminal disclaimer.

(21) Appl. No.: 12/472,833

(22) Filed: May 27, 2009

(65) Prior Publication Data

US 2009/0232683 A1 Sep. 17, 2009

Related U.S. Application Data

(63) Continuation of application No. PCT/JP2007/073571, filed on Dec. 6, 2007.

(30) Foreign Application Priority Data

Dec. 9, 2006 (JP) ..... 2006-332693
Oct. 16, 2007 (JP) ..... 2007-268503

(51) Int. Cl.
*F04B 45/04* (2006.01)

(52) U.S. Cl.
USPC ..... 417/413.2; 417/410.2; 417/413.1; 417/395; 92/98 R

(58) Field of Classification Search
USPC ..... 417/410.2, 413.2, 395, 413.1; 92/96, 92/98 R
See application file for complete search history.

(56) References Cited

U.S. PATENT DOCUMENTS

| | | | | |
|---|---|---|---|---|
| 2005/0069430 | A1 * | 3/2005 | Sugahara | 417/413.2 |
| 2005/0074662 | A1 * | 4/2005 | Cho et al. | 429/38 |
| 2005/0123420 | A1 | 6/2005 | Richter et al. | |
| 2006/0201327 | A1 * | 9/2006 | Janse Van Rensburg et al. | 96/4 |

FOREIGN PATENT DOCUMENTS

| | | | | |
|---|---|---|---|---|
| DE | 102 38 600 | A1 | 3/2004 | |
| EP | 1 369 584 | A2 | 12/2003 | |
| JP | 58-140491 | | 8/1983 | |
| JP | 64-2793 | | 1/1989 | |
| JP | 01219369 | A * | 9/1989 | F04B 43/04 |

(Continued)

OTHER PUBLICATIONS

Official Communication issued in corresponding European Patent Application No. 07859726.7, mailed on Dec. 15, 2010.

(Continued)

*Primary Examiner* — Christopher Bobish
(74) *Attorney, Agent, or Firm* — Keating & Bennett, LLP

(57) ABSTRACT

A piezoelectric micro-blower capable of efficiently conveying compressive fluid without use of a check valve and ensuring a sufficient flow rate. The micro-blower has a blower body with a first wall and a second wall. Openings are formed in the respective walls and face a center of a diaphragm. An inflow path allowing the openings to communicate with the outside is formed between the walls. By applying a voltage to a piezoelectric element to cause the diaphragm to vibrate, a part of the first wall close to the first opening vibrates. Thus, gas can be drawn from the inflow path and discharged from the opening in the second wall.

11 Claims, 9 Drawing Sheets

(56) References Cited

FOREIGN PATENT DOCUMENTS

| | | |
|---|---|---|
| JP | 2004-146574 | 5/2004 |
| JP | 2005-113918 | 4/2005 |
| JP | 2005-299597 | 10/2005 |
| JP | 2006-522896 | 10/2006 |
| WO | WO-2004/090335 | 10/2004 |

OTHER PUBLICATIONS

Official Communication issued in corresponding Chinese Patent Application No. 200780044264.5, mailed on Jun. 2, 2010.
PCT/JP2007/073571 International Search Report dated Feb. 21, 2008.
PCT/JP2007/073571 Written Opinion dated Feb. 21, 2008.

* cited by examiner (a)

(b)

PIEZOELECTRIC MICRO-BLOWER

CROSS REFERENCE TO RELATED APPLICATIONS

The present application is a continuation of International Application No. PCT/JP2007/073571, filed Dec. 6, 2007, which claims priority to Japanese Patent Application No. JP2006-332693, filed Dec. 9, 2006, and Japanese Patent Application No. JP2007-268503, filed Oct. 16, 2007, the entire contents of each of these applications being incorporated herein by reference in their entirety.

FIELD OF THE INVENTION

The present invention relates to a piezoelectric micro-blower suitable for conveying compressive fluid, such as air.

BACKGROUND OF THE INVENTION

A piezoelectric micropump is used as a cooing-water conveying pump for compact electronic devices, such as notebook computers, and also as a fuel conveying pump for fuel cells. On the other hand, a piezoelectric micro-blower is used as an air blower serving as an alternative to a cooling fan for a CPU etc., and is also used as an air blower for supplying oxygen necessary for generating electricity in fuel cells. Both the piezoelectric micropump and the piezoelectric micro-blower include a diaphragm that bends when a voltage is applied to a piezoelectric element, and have advantages of simple structure, thin profile, and low power consumption.

Typically, for conveying non-compressive fluid such as liquid, check valves made of soft material such as rubber or resin are provided at both an inlet and an outlet, and a piezoelectric element is driven at a low frequency of several tens of Hz. However, when a micropump with such check valves is used for conveying compressive fluid, such as air, the amount of displacement of the piezoelectric element is very small and fluid can be hardly discharged. Although the maximum displacement can be obtained when the piezoelectric element is driven at a frequency near a resonance frequency (first-order resonance frequency or third-order resonance frequency) of the diaphragm, since the resonance frequency is a high frequency of the order of kHz, the check valves cannot follow the displacement of the piezoelectric element. Therefore, for conveying compressive fluid, it is desirable to use a piezoelectric micro-blower having no check valve.

Patent Document 1 discloses a cooling device in which a pump chamber is formed between a pump body and a piezoelectric element, an inflow port is provided in a side surface of the pump chamber, and a discharge port is provided in a surface of the pump chamber, the surface facing the piezoelectric element. The inflow port is gradually tapered inward toward the pump chamber, while the discharge port is gradually tapered outward from the pump chamber. Since the inflow port and the discharge port are tapered as described above, the resistance of fluid passing through the inflow port is different from that of fluid passing through the discharge port. Thus, when the piezoelectric element is displaced in a direction that increases the volume of the pump chamber, fluid (e.g., air) is flown into the pump chamber through the inflow port; while when the piezoelectric element is displaced in a direction that reduces the volume of the pump chamber, fluid is discharged from the pump chamber through the outflow port. Therefore, it is possible to omit check valves for both the inflow port and the discharge port.

However, even if the inflow port and the discharge port are tapered as described above, when the piezoelectric element is displaced in the direction that increases the volume of the pump chamber, fluid is flown into the pump chamber not only through the inflow port, but also through the outflow port. Conversely, when the piezoelectric element is displaced in the direction that reduces the volume of the pump chamber, fluid is discharged not only through the outflow port, but also through the inflow port. Therefore, the total flow rate of discharge from the pump through the outflow port is smaller than the amount of change in volume of the pump chamber caused by the displacement of the piezoelectric element. Since the amount of change in volume of the pump chamber caused by the displacement of the piezoelectric element is very small, the flow rate is accordingly very low. Therefore, it is difficult for the cooling device to achieve a sufficient cooling effect.

Patent Document 2 discloses a gas flow generator that includes an ultrasonic driver having a piezoelectric disk mounted on a stainless steel disk, a first stainless steel membrane on which the ultrasonic driver is mounted, and a second stainless steel membrane mounted substantially parallel with the ultrasonic driver and spaced a predetermined distance therefrom. By applying a voltage to the piezoelectric disk, the ultrasonic driver is bent, so that air is discharged through perforations formed at the center of the second stainless steel membrane. Since the gas flow generator also has no check valve, the ultrasonic driver can be driven at high frequencies.

When the ultrasonic driver is driven at a high frequency, the gas flow generator can discharge air in a direction perpendicular to the perforations formed at the center of the second stainless steel membrane while drawing or pulling in air around the perforations, and thus can generate an inertia jet. However, the flow rate varies considerably depending on the conditions around the center perforations of the second stainless steel membrane. For example, if there is an obstacle near the center perforations, the discharge flow rate is considerably reduced. Also, if this gas flow generator is used as a cooling fan for cooling a heat source, such as a CPU, hot air around the heat source is simply blown to the heat source. This merely allows stirring of surrounding air, and thus the heat conversion efficiency is low.

Patent Document 1: Japanese Unexamined Patent Application Publication No. 2004-146547

Patent Document 2: Japanese Unexamined Patent Application Publication (Translation of PCT Application) No. 2006-522896

SUMMARY OF THE INVENTION

An object of preferred embodiments of the present invention is to provide a piezoelectric micro-blower capable of efficiently conveying compressive fluid without use of a check valve and ensuring a sufficient flow rate.

To achieve the object described above, the present invention provides a piezoelectric micro-blower including a blower body, a diaphragm secured to the blower body at a perimeter thereof and having a piezoelectric element, and a blower chamber formed between the blower body and the diaphragm. The piezoelectric micro-blower conveys compressive fluid by applying a voltage to the piezoelectric element to cause the diaphragm to bend. The piezoelectric micro-blower includes a first wall on the blower body, the first wall forming the blower chamber between the diaphragm the first wall; a first opening formed in a part of the first wall and facing a center of the diaphragm, the first opening allowing the inside and outside of the blower chamber to communicate with each other; a second wall spaced from the first wall and disposed opposite the blower chamber with the first wall interposed between the second wall and the blower chamber; a second opening formed in a part of the second wall and facing the first opening; and an inflow path formed between the first wall and the second wall, having outer ends communicating with the outside, and having inner ends connected to the first opening and the second opening.

REFERENCE NUMERALS

Figure 1A:
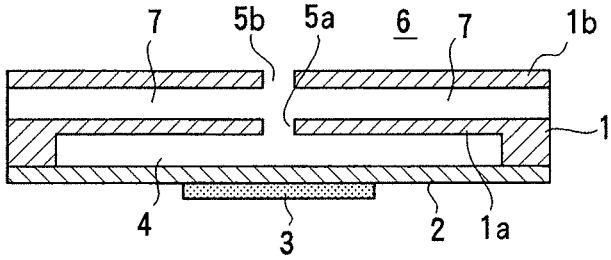
FIGS. 1(*a*) to 1(*e*) illustrate an operating principle of a piezoelectric micro-blower according to an embodiment of the present invention.
Figure 1B:
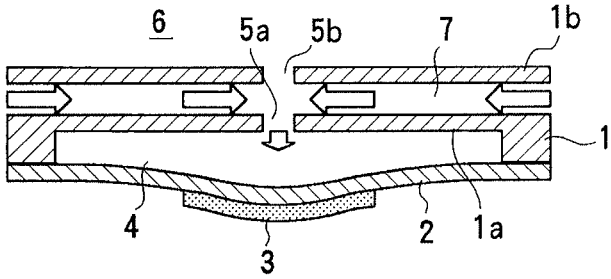
Figure 1C:
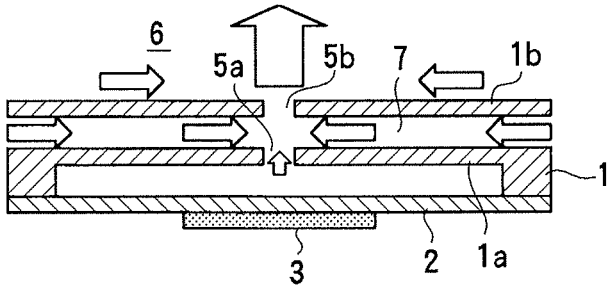
Figure 1D:
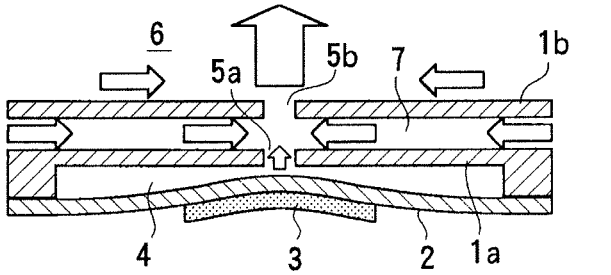
Figure 1E:
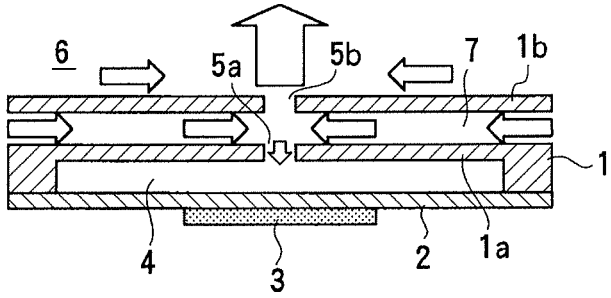
Figure 2:
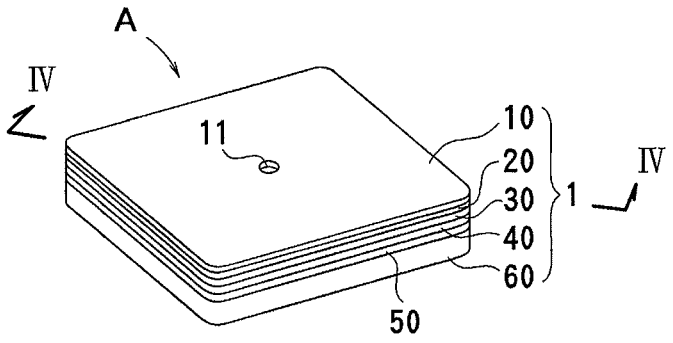
FIG. 2 is an overall perspective view illustrating the piezoelectric micro-blower according to the first embodiment of the present invention.
Figure 3:
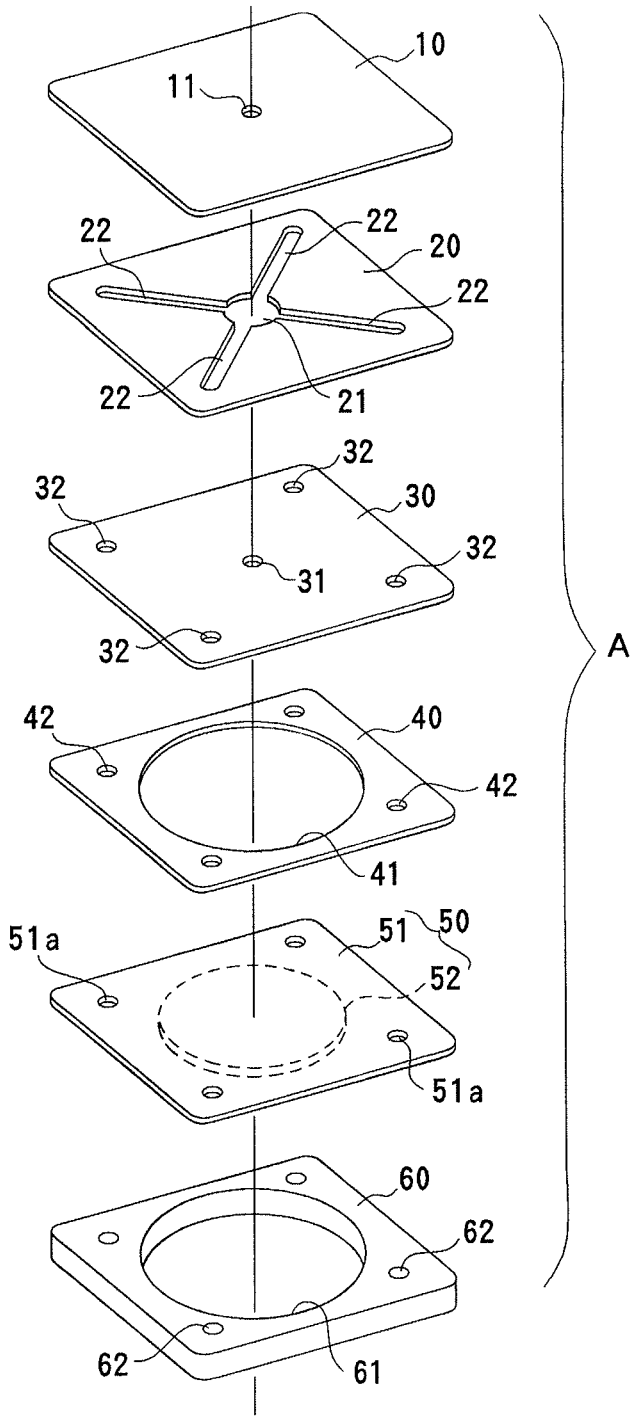
FIG. 3 is an exploded perspective view of the piezoelectric micro-blower illustrated in FIG. 2.

A-D: piezoelectric micro-blower
1: blower body
2: diaphragm
3: piezoelectric element
4: blower chamber
8: inlet
10: top plate (second wall)
11: outlet (second opening)
20: flow path plate
21: center space
22: inflow path
30: separator (first wall)
31: through hole (first opening)
40: blower frame
50, 50*a*, 50*b*: diaphragm
51: vibrating plate
52, 52*a*: piezoelectric element
60: bottom plate

DETAILED DESCRIPTION OF THE INVENTION

FIG. 1(*a*) illustrates an example of a basic structure of a piezoelectric micro-blower according to the present invention. The piezoelectric micro-blower includes a blower body 1 and a diaphragm 2 having a perimeter secured to the blower body 1. A piezoelectric element 3 is attached to the center of the backside of the diaphragm 2. A blower chamber 4 is formed between a first wall 1*a* of the blower body 1 and the diaphragm 2. A first opening 5*a* is provided in a part of the first wall 1*a* facing the center of the diaphragm 2. Application of a voltage to the piezoelectric element 3 causes the diaphragm 2 to bend and causes the distance between the first opening 5*a* and the diaphragm 2 to vary. The blower body 1 has a second wall 1*b* spaced from the first wall 1*a* and disposed opposite the blower chamber 4, with the first wall 1*a* interposed therebetween. A second opening 5*b* is provided at part of the second wall 1*b* facing the first opening 5*a*. The first wall 1*a* and the second wall 1*b* define an inflow path 7 having outer ends communicating with the outside of the blower body 1 and inner ends connected to the first opening 5*a* and the second opening 5*b*.

FIGS. 1(*a*) to (*e*) illustrate a blower operation in which the diaphragm 2 is displaced in a first-order resonance mode. FIG. 1(*a*) illustrates an initial state (no voltage applied state) where the diaphragm 2 is flat. FIG. 1(*b*) illustrates the first quarter cycle of a voltage applied to the piezoelectric element 3. Since the diaphragm 2 is bent downward, the distance between the first opening 5*a* and the diaphragm 2 increases, and fluid is drawn through the first opening 5*a* into the blower chamber 4. Arrows in the drawing indicate the flows of fluid. At this point, fluid in the inflow path 7 is partially drawn into the blower chamber 4. In the next quarter cycle, the diaphragm 2 returns to the flat state as illustrated in FIG. 1(*c*). Thus, the distance between the first opening 5*a* and the diaphragm 2 decreases, and the fluid is forced out and flows upward through the openings 5*a* and 5*b*. Since the fluid flows upward while pulling in the fluid in the inflow path 7, a high flow rate can be obtained at the outlet of the second opening 5*b*. In the next quarter cycle, since the diaphragm 2 is bent upward as illustrated in FIG. 1(*d*), the distance between the first opening 5*a* and the diaphragm 2 decreases, and the fluid in the blower chamber 4 is forced out at high speed and flows upward through the openings 5*a* and 5*b*. Since this high-speed flow flows upward while pulling in the fluid in the inflow path 7, a high flow rate can be obtained at the outlet of the second opening 5*b*. In the next quarter cycle, as illustrated in FIG. 1(*e*), the diaphragm 2 returns to the flat state. Thus, the distance between the first opening 5*a* and the diaphragm 2 increases, and the fluid passes through the first opening 5*a* and is drawn into the blower chamber 4 to some extent. However, inertia causes the fluid in the inflow path 7 to keep flowing toward the center of the blower body 1 and in the direction along which the fluid is forced out of the blower chamber. Then, the operation of the diaphragm 2 returns to FIG. 1(*b*) and the operations in FIGS. 1 (*b*) to (*e*) are repeated cyclically. By causing the diaphragm 2 to bend and vibrate at a high frequency, the next flow can be generated at the openings 5*a* and 5*b* before the inertia of the fluid flowing through the inflow path 7 ends. Thus, a flow of fluid toward the center of the blower body 1 can be constantly generated in the inflow path 7. This can be done by the following. That is, when the diaphragm 2 is displaced in the direction along which the distance between the first opening 5*a* and the diaphragm 2 increases, the fluid in the inflow path 7 is drawn through the first opening 5*a* into the blower chamber 4; and when the diaphragm 2 is displaced in the direction along which the distance between the first opening 5*a* and the diaphragm 2 decreases, the fluid in the inflow path 7 outside the blower chamber 4 is drawn into a high-speed flow forced out of the blower chamber 4 through the second opening 5*b*, and is forced out together with the high-speed flow.

In the present embodiment, in response to the displacement of the diaphragm 2, the fluid in the inflow path 7 can be drawn into the openings 5*a* and 5*b* by the fluid flowing through the openings 5*a* and 5*b* at high speed. That is, when the diaphragm 2 is displaced not only in the downward direction but also in the upward direction, the fluid can be drawn from the inflow path 7 into the openings 5*a* and 5*b*. Since the fluid drawn from the inflow path 7 and the fluid forced out of the blower chamber 4 are joined together and discharged from the second opening 5*b*, the amount of discharge flow can be greater than or equal to the volume of the pump chamber changed by displacement of the diaphragm 2. Since the inflow path 7 is connected to the space between the openings 5*a* and 5*b* and is not directly connected to the blower chamber 4, the inflow path 7 is unaffected by changes in pressure in the blower chamber 4. Therefore, even if no check valve is provided, a high-speed flow flowing through the openings 5*a* and 5*b* can be prevented from flowing backward into the inflow path 7, and thus the flow rate can be effectively increased.

In the present piezoelectric micro-blower, the second opening 5*b* serving as an outlet for fluid can be disposed away from the outer ends of the inflow path 7, the outer ends serving as inlets for fluid. Therefore, for example, when the present piezoelectric micro-blower is used as a cooling fan for cooling a heat source, such as a CPU, if the second opening 5*b* is directed toward the heat source and the outer ends of the inflow path 7 are connected to a cool air space, cool air taken from the cool air space can be blown to the heat source.

It is preferable that a center space having an opening area greater than those of the first and second openings be formed at the inner ends of the inflow path connected to the first and second openings. In this case, fluid having passed through the inflow path is temporarily collected in the center space, and discharged from the second opening by and together with the flow of fluid blown out of the first opening. If the inflow path includes a plurality of paths radially extending from the center space, and the outer end of each path is provided with an inlet, a greater path area of the inflow path can be ensured. This makes it possible to reduce flow path resistance and to further increase the flow rate.

As described above, when the center space having an opening area greater than those of the first and second openings is formed at the inner ends of the inflow path, the opening area of the center space is preferably set such that a part of the first wall, the part facing the center space, resonates in response to the displacement of the diaphragm. That is, if the natural frequency of this part of the first wall is set at a value close to the vibration frequency of the diaphragm, this part of the first wall can resonate following the displacement of the diaphragm. In this case, the flow rate of fluid generated by the diaphragm can be increased by the displacement of the first wall. Thus, a further increase in flow rate can be achieved.

The diaphragm of the present invention may be any of the following types: a unimorph diaphragm formed by attaching a piezoelectric element to one surface of a resin plate or a metal plate, the piezoelectric element expanding and contracting in a planer direction; a bimorph diaphragm formed by attaching piezoelectric elements to both surfaces of a resin plate or a metal plate, the piezoelectric elements each expanding and contracting in a direction opposite that of the other piezoelectric element; a bimorph diaphragm formed by attaching a multilayer piezoelectric element to one surface of a resin plate or a metal plate, the multilayer piezoelectric element being capable of bending itself; and a diaphragm entirely composed of a multilayer piezoelectric element. In other words, the diaphragm of the present invention may be of any type, as long as it can bend and vibrate in the through-thickness direction by applying an alternate voltage (a sinusoidal voltage or a rectangular wave voltage) to the piezoelectric element.

It is preferable to drive the diaphragm including the piezoelectric element in the first-order resonance mode (at the first-order resonance frequency), since a maximum amount of displacement can be obtained. However, since the first-order resonance frequency is in the audio range, the level of noise may be increased. On the other hand, if the third-order resonance mode (third-order resonance frequency) is used, the amount of displacement of the diaphragm is smaller than that in the first-order resonance mode, but is greater than that in the case where no resonance mode is used. Moreover, since the diaphragm can be driven at a frequency outside the audio range, the occurrence of noise can be prevented. The first-order resonance mode refers to a mode in which the center and perimeter of the diaphragm are displaced in the same direction, while the third-order resonance mode refers to a mode in which the center and perimeter of the diaphragm are displaced in opposite directions.

When the third-order resonance mode is used, if the center of the diaphragm is displaced upward, the perimeter of the diaphragm is displaced downward. If the piezoelectric element is disk-shaped, since a node of displacement is present between the center and perimeter of the diaphragm, wiring is generally made in a part of the piezoelectric element, the part corresponding to the node. However, the node is present in a very limited area in the middle of the piezoelectric element. Therefore, it is difficult to carry out the wiring operation, such as soldering, and reliability may be degraded. On the other hand, if the piezoelectric element has an annular shape, the perimeter of the piezoelectric element can be disposed closer to the blower body that holds the perimeter of the diaphragm. Therefore, the wiring can be made by simply connecting lead wires to the perimeter of the piezoelectric element. Thus, the wiring operation can be simplified and reliability can be improved.

As described above, in the piezoelectric micro-blower of the present invention, by causing the diaphragm to bend and vibrate, fluid in the inflow path can be drawn through the first opening into the blower chamber, and the fluid in the inflow path outside the blower chamber can be drawn into a high-speed flow forced out of the blower chamber through the second opening and can be forced out together with the high-speed flow. Therefore, the amount of discharge flow can be greater than or equal to the volume of the pump chamber changed by displacement of the diaphragm, and a blower having a high flow rate can be realized. At the same time, since a high-speed flow flowing through the two openings can be prevented from flowing backward into the inflow path without use of a check valve, the flow rate can be increased effectively.

Hereinafter, preferred modes for carrying out the present invention will be described in accordance with embodiments.

First Embodiment

FIG. 2 to FIG. 5 illustrate a piezoelectric micro-blower according to a first embodiment of the present invention. A piezoelectric micro-blower A of the present embodiment is used as an air cooling blower for an electronic device. The piezoelectric micro-blower A includes, in order from the top, a top plate (second wall) 10, a flow path plate 20, a separator (first wall) 30, a blower frame 40, a diaphragm 50, and a bottom plate 60 that are stacked and secured together. The perimeter of the diaphragm 50 is bonded and secured between the blower frame 40 and the bottom plate 60. The above-described components except the diaphragm 50, that is, the components 10, 20, 30, 40, and 60 constitute the blower body 1 and are metal or hard resin plates formed of flat sheet materials having high stiffness.

The top plate 10 is a rectangular flat plate having an outlet (second opening) 11 at the center thereof. The outlet 11 penetrates the top plate 10 from the front surface to the back surface.

Figure 5:
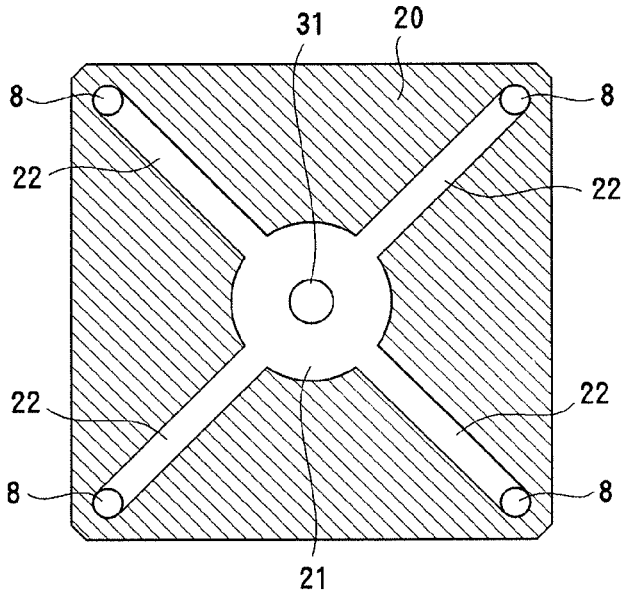
FIG. 5 is a cross-sectional view taken along line V-V of FIG. 4.

The flow path plate 20 is a flat plate having the same outer shape as that of the top plate 10. As illustrated in FIG. 5, a center hole (center space) 21 having a diameter greater than that of the outlet 11 is formed at the center of the flow path plate 20. The flow path plate 20 has a plurality of inflow paths 22 (four in the present embodiment) extending radially from the center hole 21 to respective four corners. In the piezoelectric micro-blower A of the present embodiment, since the inflow paths 22 communicate with the center hole 21 from four directions, fluid is drawn into the center hole 21, without resistance, by pumping operation of the diaphragm 50. Thus, a further increase in flow rate can be achieved.

The separator 30 is also a flat plate having the same outer shape as that of the top plate 10. A through hole (first opening) 31 having a diameter substantially the same as that of the outlet 11 is formed at the center of the separator 30 and at a position facing the outlet 11. The diameters of the outlet 11 and through hole 31 may either be the same or different, but are at least smaller than the diameter of the center hole 21. Inflow holes 32 are formed near respective four corners of the separator 30 and at positions corresponding to respective outer ends of the inflow paths 22. By bonding the top plate 10, the flow path plate 20, and the separator 30 together, the outlet 11, the center hole 21, and the through hole 31 are aligned on the same axis and face the center of the diaphragm 50 described below. As will be described, to cause a part corresponding to the center hole 21 of the separator 30 to resonate, it is desirable that the separator 30 be a thin metal plate.

The blower frame 40 is also a flat plate having the same outer shape as that of the top plate 10. A hollow 41 having a large diameter is formed at the center of the blower frame 40. Inflow holes 42 are formed near respective four corners of the blower frame 40 and at positions corresponding to the respective inflow holes 32. By bonding the separator 30 and the diaphragm 50 to each other with the blower frame 40 interposed therebetween, the hollow 41 of the blower frame 40 can serve as the blower chamber 4. The blower chamber 4 does not have to be a closed space, but may be partially opened. For example, the hollow 41 formed at the center of the blower frame 40 may be provided with a slit communicating with the outside of the blower frame 40. Alternatively, for example, a block-like blower frame may be formed only around each of the inflow holes 42. In other words, the blower chamber 4 of the present invention may be any space interposed between and defined by the separator 30 and the diaphragm 50.

The bottom plate 60 is also a flat plate having the same outer shape as that of the top plate 10. A hollow 61 having substantially the same shape as that of the blower chamber 3 is formed at the center of the bottom plate 60. The bottom plate 60 has a thickness greater than the sum of the thickness of a piezoelectric element 52 and the amount of displacement of a vibrating plate 51. Therefore, even when the micro-blower A is mounted on a substrate, the piezoelectric element 52 can be prevented from being in contact with the substrate. The hollow 61 is a portion surrounding the piezoelectric element 52 of the diaphragm 50 described below. Inflow holes 62 are formed near respective four corners of the bottom plate 60 and at positions corresponding to the inflow holes 32 and 42.

The diaphragm 50 has a structure in which the piezoelectric element 52 of circular shape is attached to the center of the lower surface of the vibrating plate 51. The vibrating plate 51 may be formed of a metal material, such as stainless steel or brass, or may be a resin plate formed of a resin material, such as glass epoxy resin. The piezoelectric element 52 is a circular plate having a diameter smaller than that of the hollow 41 of the blower frame 40. In the present embodiment, a single piezoelectric ceramic plate having electrodes on both the front and back surfaces thereof is used as the piezoelectric element 52. The piezoelectric element 52 is attached to the back surface of the vibrating plate 51 (i.e., the surface distant from the blower chamber 3) to form a unimorph diaphragm. The application of an alternate voltage (a sinusoidal wave or a rectangular wave) to the piezoelectric element 52 causes the piezoelectric element 52 to expand and contract in a planer direction. This causes the entire diaphragm 50 to bend in the through-thickness direction. By applying to the piezoelectric element 52 an alternate voltage that causes the diaphragm 50 to be bent in the first-order resonance mode or third-order resonance mode, the volume of the pump chamber changed by displacement of the diaphragm 50 can be made much greater than that in the case where a voltage of any other frequency is applied to the piezoelectric element 52. Thus, a significant increase in flow rate can be achieved.

Inflow holes 51*a* are formed near respective four corners of the vibrating plate 51 and at positions corresponding to the inflow holes 32, 42, and 62. The inflow holes 32, 42, 62, and 51*a* define inlets 8, each opening downward at one end and communicating with the inflow path 22 at the other end.

Figure 4:
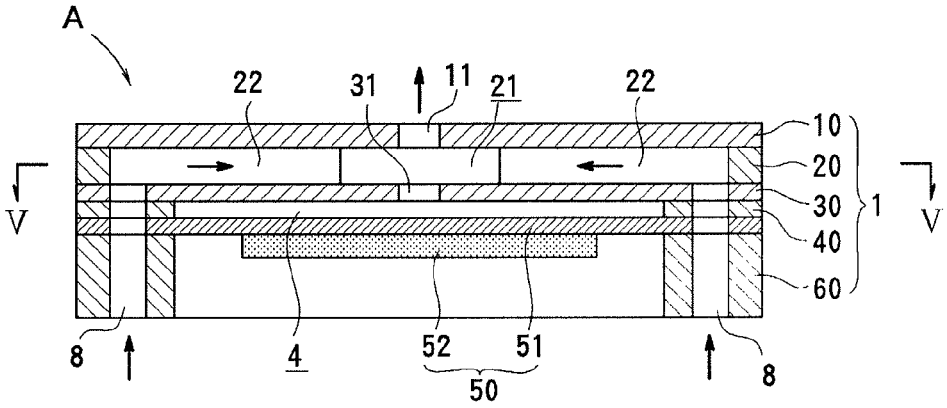
FIG. 4 is a cross-sectional view taken along line IV-IV of FIG. 2.

As illustrated in FIG. 4, the inlets 8 of the piezoelectric micro-blower A open toward the lower side of the blower body 1, while the outlet 11 opens toward the upper side of the blower body 1. Compressive fluid can be taken from the inlets 8 on the backside of the piezoelectric micro-blower A and discharged from the outlet 11 on the front side of the piezoelectric micro-blower A. Thus, there can be provided a structure that is suitable for use as an air supply blower for fuel cells, or as an air cooling blower for a CPU. The inlets 8 do not have to open downward, and may open at the periphery of the blower body 1.

Figure 6:
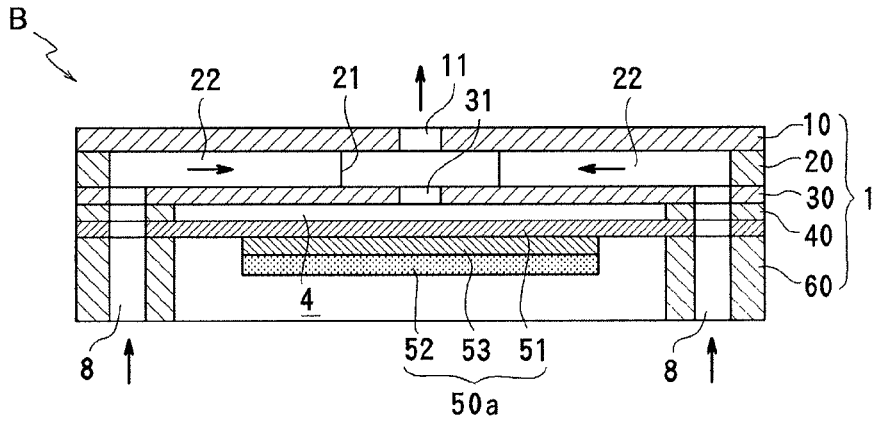
FIG. 6 is a cross-sectional view of a modification of the piezoelectric micro-blower illustrated in FIG. 4.
Figure 7A:
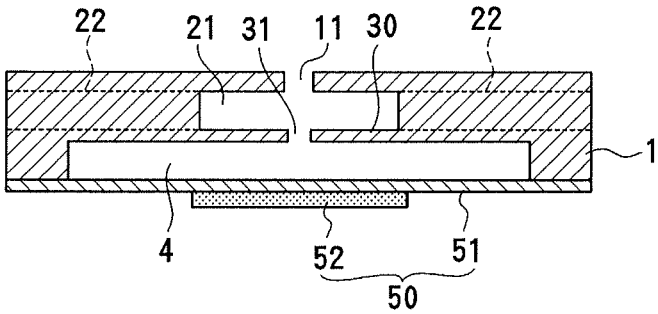
FIGS. 7(*a*) to 7(*e*) schematically illustrate an operation of the piezoelectric micro-blower of FIG. 2.
Figure 7B:
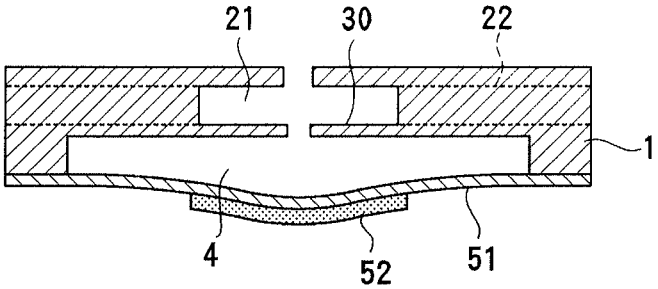
Figure 7C:
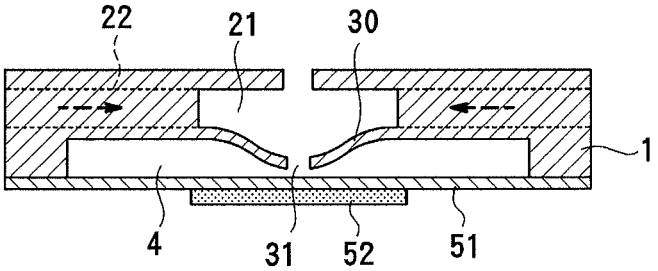
Figure 7D:
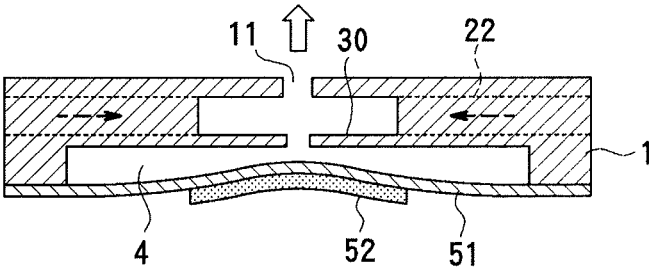
Figure 7E:
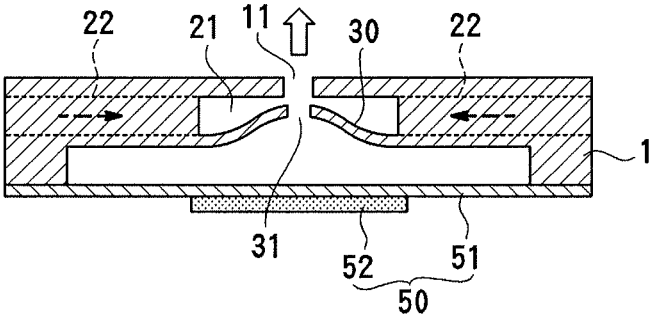

The diaphragm 50 illustrated in FIG. 4 includes the vibrating plate 51 and the piezoelectric element 52. Alternatively, as illustrated in FIG. 6, an intermediate plate 53 may be interposed between the vibrating plate 51 and the piezoelectric element 52 to form a diaphragm 50*a*. The intermediate plate 53 may be a metal plate, such as a SUS plate. By providing the intermediate plate 53 between the vibrating plate 51 and the piezoelectric element 52, a neutral plane for bending of the diaphragm 50*a* can be located in the intermediate plate 53, and factors interfering with the displacement can be eliminated. As a result, a further improvement in displacement efficiency can be achieved, and a low-voltage high-flow-rate piezoelectric micro-blower B can be obtained.

The operation of the piezoelectric micro-blower A of the present embodiment is substantially the same as that illustrated in FIG. 1. However, in the present embodiment, the center space 21 having an opening area greater than those of the first opening 31 and second opening 11 is formed at the inner ends of the inflow paths 22, and a thin metal plate is provided as the separator 30. This allows the operation shown in FIGS. 7(*a*) to 7(*e*) and a further increase in flow rate.

FIGS. 7(*a*) to 7(*e*) are schematic views describing an operation of the piezoelectric micro-blower A. Displacements are enlarged in these figures for clarity. FIG. 7(*a*) illustrates an initial state (no voltage applied state). FIGS. 7(*b*) to (*e*) illustrate the displacement of the diaphragm 50 and separator 30 in each quarter cycle of a voltage (e.g., a sine wave) applied to the piezoelectric element 52. By applying an alternate voltage to the piezoelectric element 52, the operations in FIGS. 7 (*b*) to (*e*) are repeated cyclically. As illustrated, the separator 30 resonates in response to the vibration of the diaphragm 50. The separator 30 vibrates with a phase delay of about 90° relative to the vibration of the diaphragm 50. When the separator 30 resonates, a large pressure wave is generated upward through the first opening 31, and causes air in the center space 21 to be discharged outward through the second opening 11. Therefore, the flow rate can be higher than that in the case where the separator 30 does not resonate. When air in the center space 21 is discharged outward, air in the inflow paths 22 is drawn toward the center space 21. Thus, airflow can be continuously generated through the second opening 11.

Although FIGS. 7(*a*) to 7(*e*) illustrate an example where the diaphragm 50 is displaced in the first-order resonance mode, the same operation applies to the case where the diaphragm 50 is displaced in the third-order resonance mode. Moreover, although FIGS. 7(*a*) to 7(*e*) illustrate an example where the displacement of the separator 30 is greater than that of the diaphragm 50, the displacement of the separator 30 may be smaller than that of the diaphragm 50, depending on the size of the center space 21, the Young's modulus and thickness of the separator 30, etc. Additionally, the phase delay of the separator 30 relative to the diaphragm 50 is not limited to 90°. That is, it is only necessary that the separator 30 vibrate in response to the vibration of the diaphragm 50 with some phase delay, and thus the distance between the diaphragm 50 and the separator 30 is varied more greatly than in the case where the separator 30 does not vibrate.

The following data shows results of an experiment for evaluating the micro-blower A having the above-described structure. First, there was prepared a diaphragm formed by attaching a piezoelectric element to a SUS plate 0.1 mm in thickness, the piezoelectric element being composed of a single PZT plate 0.15 mm in thickness and 12.7 mm in diameter. Next, there were prepared a separator composed of a brass plate; and a top plate, a flow path plate, a blower frame, and a bottom plate composed of SUS plates. A second opening 0.8 mm in diameter was provided at the center of the top plate. A first opening 0.6 mm in diameter was provided at the center of the separator. A center space 6 mm in diameter and 0.4 mm in height was provided at the center of the flow path plate. Next, the above-described components were stacked in the following order: the bottom plate, diaphragm, blower frame, separator, flow path plate, and top plate. They were bonded together to form a blower body measuring 20 mm long by 20 mm wide by 2.4 mm high. The blower chamber of the blower body was designed to be 0.15 mm in height and 18 mm in diameter.

When a sine wave voltage of 17-kHz frequency and 60 Vp-p was applied to drive the micro-blower A having the above-described structure, a flow rate of 800 ml/min was achieved at 100 Pa. Although this is an example where the micro-blower A was driven in the third-order mode, it is also possible to drive the micro-blower A in the first-order mode. Thus, a micro-blower with a high flow rate was obtained.

Table 1 shows flow rates corresponding to different drive frequencies for the diaphragm 50 and different diameters of the center space 21. The flow rates are expressed in L/min.

TABLE 1

| | | Diameter of Center Space | |
|---|---|---|---|
| | | ϕ5 mm | ϕ6 mm |
| Frequency | 24.4 kHz | 0.7 | 0.8 |
| | 25.5 kHz | 0.78 | 0.71 |

The thickness of a 42Ni plate used at a drive frequency of 24.4 kHz was 0.08 mm, while the thickness of a 42Ni plate used at a drive frequency of 25.5 kHz was 0.1 mm.

As is apparent from Table 1, when the center space 21 was 5 mm in diameter, a higher flow rate was achieved at a higher frequency. On the other hand, when the center space 21 was 6 mm in diameter, a higher flow rate was achieved at a lower frequency. This shows that the flow rate was affected by vibrations of the separator 30 corresponding to the center space 21. This was probably because, although the natural frequency of the diaphragm varies depending on the material and thickness of the vibrating plate 51, the separator 30 corresponding to the center space 21 was able to resonate at a natural frequency close to that of the diaphragm by adjusting the diameter of the center space 21 and thus, the flow rate was increased.

Figure 8A:
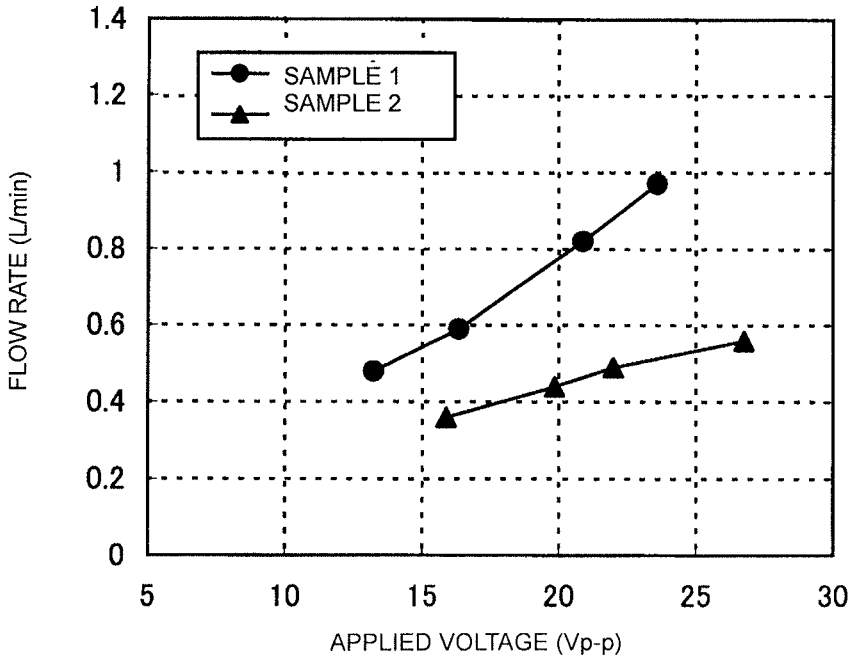
FIGS. 8(*a*) and 8(*b*) illustrate, for samples having respective separators of different materials and thicknesses, flow rate characteristics versus applied voltage, and flow rate characteristics versus power consumption.
Figure 8B:
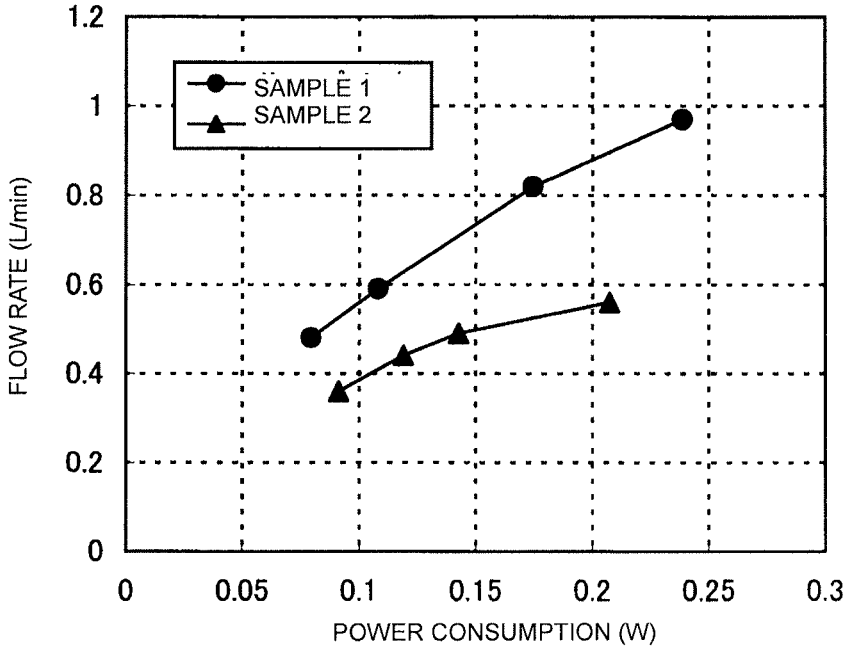

FIGS. 8(*a*) and 8(*b*) show results of an experiment for evaluating the piezoelectric micro-blower B, in which the diaphragm 50 includes the vibrating plate 51, the piezoelectric element 52, and the intermediate plate 53 interposed therebetween. This experiment compared flow rates of samples having respective separators 30 with different materials and thicknesses as shown in Table 2. Sample 1 included a phosphor bronze separator 0.05 mm in thickness, while Sample 2 included a SUS304 separator 0.1 mm in thickness. The other components were the same as those of the micro-blower A. The components, except the separators, were common to Sample 1 and Sample 2. The drive frequency was 24.4 kHz for both Sample 1 and Sample 2.

TABLE 2

| | Sample 1 | Sample 2 |
|---|---|---|
| Material of Separator | phosphor bronze | SUS304 |
| Thickness of Separator (mm) | 0.05 | 0.1 |
| Diameter of First Opening (mm) | 0.6 | 0.6 |
| Material of Top Plate | nickel silver | nickel silver |
| Diameter of Second Opening (mm) | 0.8 | 0.8 |
| Material of Blower Chamber | nickel silver | nickel silver |
| Height of Blower Chamber (mm) | 0.15 | 0.15 |
| Diameter of Blower Chamber (mm) | 16 | 16 |
| Material of Vibrating Plate | 42Ni | 42Ni |
| Thickness of Vibrating Plate (mm) | 0.08 | 0.08 |
| Thickness of Intermediate Plate (mm) | 0.15 | 0.15 |
| Diameter of Intermediate Plate (mm) | 11 | 11 |
| Thickness of Piezoelectric Element (mm) | 0.20 | 0.20 |
| Diameter of Piezoelectric Element (mm) | 11 | 11 |
| Diameter of Center Space (mm) | 6 | 6 |
| Height of Center Space (mm) | 0.5 | 0.5 |

If SUS304 and phosphor bronze separators of equal thickness are compared, the stiffness of the SUS304 separator is about 1.5 times that of the phosphor bronze separator. However, since the thickness of the SUS304 separator was twice that of the phosphor bronze separator, the stiffness of the separator in Sample 2 was much higher than that of the separator in Sample 1. In other words, although a part of the separator, the part facing the center space, would vibrate in Sample 1, such part of the separator would hardly vibrate in Sample 2. This experiment measured the effect of vibrations of a part of the separator on the flow rate, the part facing the center space.

As shown in FIG. 8(*a*), for example, when Sample 1 and Sample 2 are compared at an applied voltage of 20 Vpp, the flow rate of Sample 1 is about 0.78 L/min while that of Sample 2 is about 0.42 L/min. That is, the flow rate of Sample 1 is about twice that of Sample 2. Thus, vibrations of the above-described part of the separator greatly contribute to an increased flow rate. FIG. 8(*b*) compares the flow rates of Sample 1 and Sample 2 on the basis of power consumption. Although power consumption varies with impedance, a comparison at the same power consumption level shows that Sample 1 is more advantageous.

Second Embodiment

Figure 9:
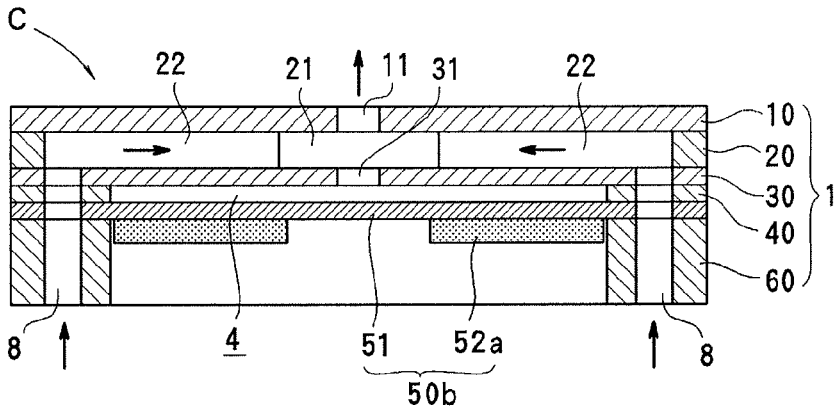
FIG. 9 is a cross-sectional view illustrating the piezoelectric micro-blower according to the second embodiment of the present invention.

FIG. 9 illustrates a micro-blower according to a second embodiment of the present invention. In the second embodiment, parts identical to those of the first embodiment are given the same symbols, and redundant description will be omitted. In the micro-blower B of the present embodiment, an annular piezoelectric element 52*a* having a hollow at its center is used as a piezoelectric element. Then, the perimeter of the piezoelectric element 52*a* is disposed near the blower body 1 holding the perimeter of a diaphragm 50*b*.

Figure 10:
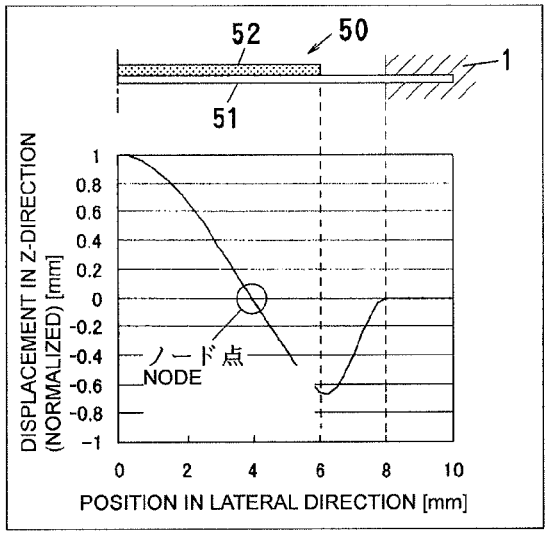
FIGS. 10(*a*) and 10(*b*) compare displacement of a diaphragm including a disk-shaped piezoelectric element and that of a diaphragm including an annular piezoelectric element.
Figure 10:
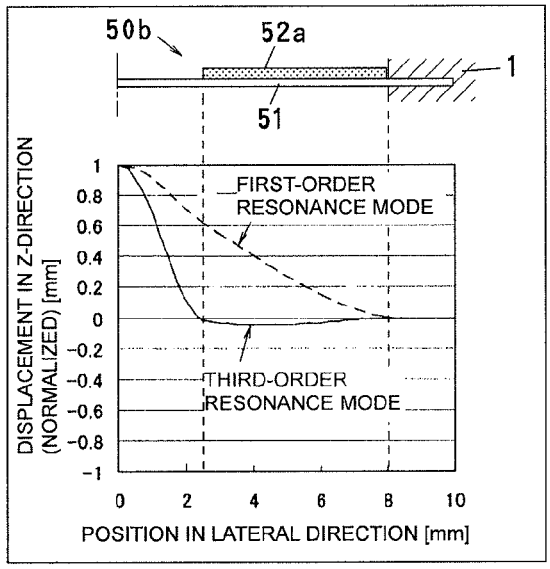

FIGS. 10(*a*) and 10(*b*) show how the diaphragm including the disk-shaped piezoelectric element and the diaphragm including the annular piezoelectric element are displaced in the third-order resonance mode. When the disk-shaped piezoelectric element 52 is used, as illustrated in FIG. 10(*a*), the piezoelectric element extends from the center position (0 mm) to the position of 6 mm. When the annular piezoelectric element 52*b* is used, as illustrated in FIG. 10(*b*), there is a hollow extending from the center position (0 mm) to the position of 2.5 mm, and the piezoelectric element extends from the position of 2.5 mm to the position of 8 mm. In both cases, a region extending from the position of 8 mm or more at the perimeter of the diaphragms 50 and 50*b* is held by the blower body 1.

As shown in FIG. 10(*a*), when the diaphragm 50 having the disk-shaped piezoelectric element 52 is vibrated in the third-order resonance mode, a node is located in an intermediate region (at the position of 4 mm) of the piezoelectric element 52. It is preferable that the connection of lead wires to the piezoelectric element 52 be made at the node. However, the node is a point located in the middle of the piezoelectric element 52. This means that to connect lead wires to the node in such a manner that vibrations do not cause the lead wires to break, it is necessary to perform high-precision positioning in a small area. This makes it difficult to carry out wiring. On the other hand, as illustrated in FIG. 10(*b*), in the case of the diaphragm 50*b* having the annular piezoelectric element 52*a*, the perimeter of the piezoelectric element 52*a* can be disposed near the blower body 1. Therefore, lead wires can be simply connected to the perimeter of the piezoelectric element 52*a*, and the point of connection hardly vibrates. Thus, it is easy to carry out wiring and reliability is improved.

The following data shows results of an experiment for evaluating a micro-blower C having a diaphragm including an annular piezoelectric element. First, there was prepared a diaphragm formed by attaching a piezoelectric element to a brass plate 0.1 mm in thickness. The piezoelectric element was composed of a single annular PZT plate 0.2 mm in thickness, 18 mm in outside diameter, and 5 mm in inside diameter. Next, there were prepared a separator composed of a brass plate; and a top plate, a flow path plate, a blower frame, and a bottom plate composed of SUS plates. A second opening 1.0 mm in diameter was provided at the center of the top plate. A first opening 0.8 mm in diameter was provided at the center of the separator. A center space 6 mm in diameter and 0.5 mm in height was provided at the center of the flow path plate. Next, the above-described components were stacked in the following order: the bottom plate, diaphragm, blower frame, separator, flow path plate, and top plate. They were bonded together to form a blower body measuring 20 mm long by 20 mm wide by 4.0 mm high. The blower chamber of the blower body was designed to be 0.05 mm in height and 18 mm in diameter.

When a sine wave voltage of 25.2-kHz frequency and 60 Vp-p was applied to drive the micro-blower C having the above-described structure, a flow rate of 700 ml/min at 100 Pa and a maximum developed pressure of 0.7 kPa were obtained. Although this is an example where the micro-blower C was driven in the third-order mode, it is also possible to drive the micro-blower C in the first-order mode. As illustrated in FIG. 10(*b*), when the annular piezoelectric element 52*a* is used, the amount of displacement of the center of the diaphragm 50*b* is very large. For example, since the natural frequency of a brass plate 0.1 mm in thickness and 5 mm in diameter is about 25 kHz, when the micro-blower C in which the vibrating plate 51 is 0.1 mm in thickness and the annular piezoelectric element 52*a* is 5 mm in inside diameter is driven at about 25 kHz, bending of the annular piezoelectric element 52*a* causes the center of the diaphragm 50*b* to resonate. Thus, a very large amount of displacement can be obtained at the center of the diaphragm 50*b*, and an increase in flow rate can be achieved. Additionally, since the piezoelectric element is not present in the part where the maximum displacement is obtained, the displacement and driving speed of the piezoelectric element can be reduced, and an improvement in durability can be achieved.

Third Embodiment

Figure 11:
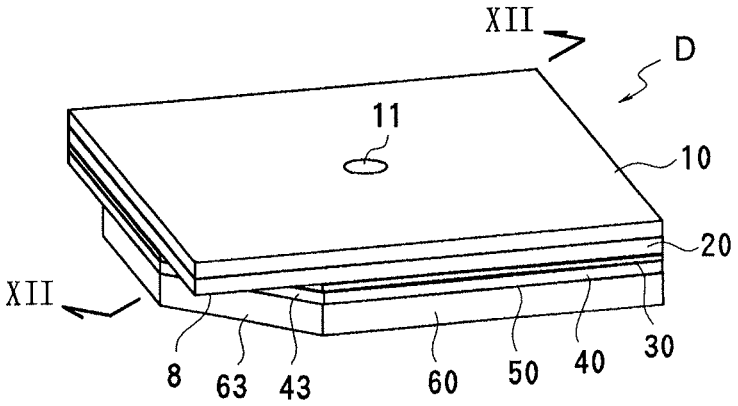
FIG. 11 is a perspective view illustrating the piezoelectric micro-blower according to the third embodiment of the present invention.
Figure 12:
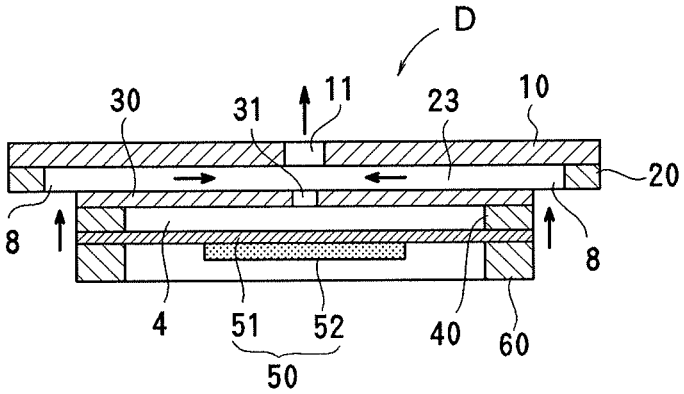
FIG. 12 is a cross-sectional view taken along line XII-XII of FIG. 11.
Figure 13:
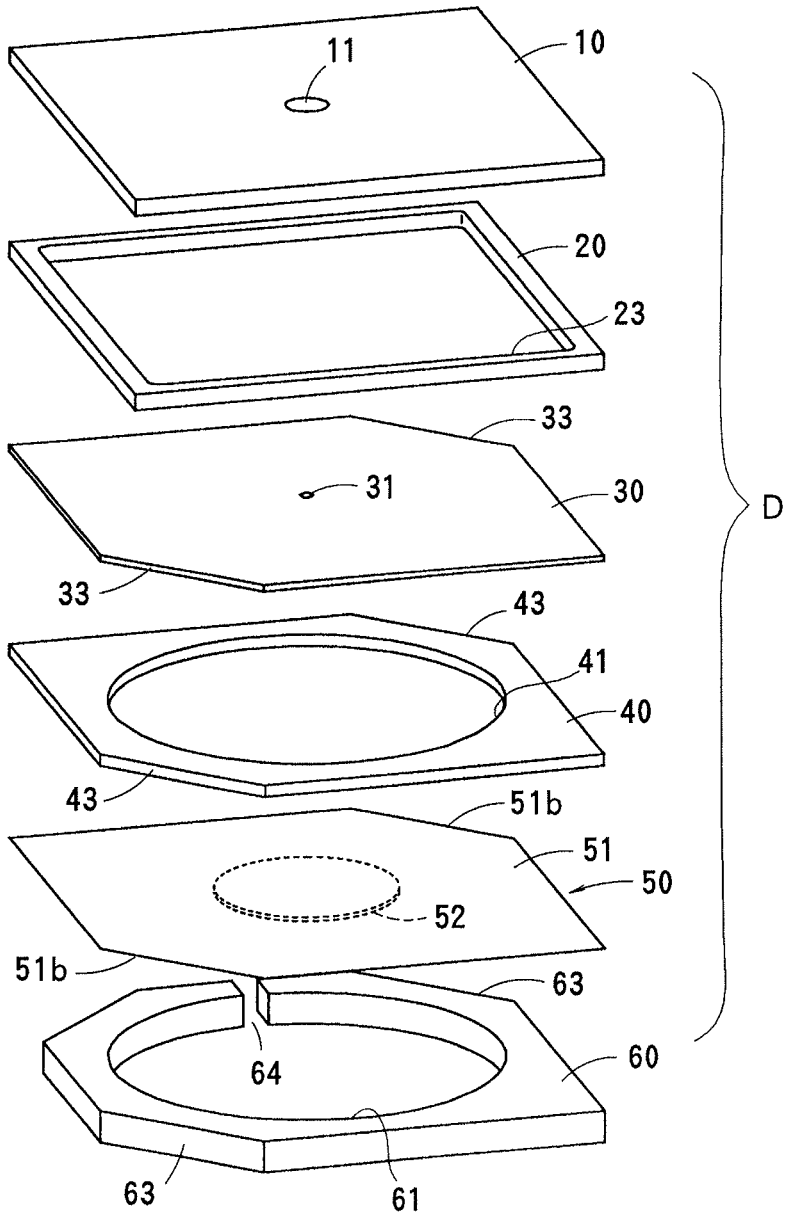
FIG. 13 is an exploded perspective view of the piezoelectric micro-blower illustrated in FIG. 11.

FIG. 11 to FIG. 13 illustrate a micro-blower according to a third embodiment of the present invention. In the third embodiment, parts identical to those of the first embodiment are given the same symbols, and redundant description will be omitted. In a micro-blower D of the present embodiment, a rectangular center space 23 serving also as an inflow path is formed in the center of the flow path plate 20. The center space 23 has an opening area greater than that of the hollow 41 of the blower frame 40, the hollow 41 constituting the blower chamber 4. The separator (first wall) 30, the blower frame 40, the bottom plate 60, and the diaphragm 50 are provided with notches 33, 43, 63, and 51*b*, respectively, at their two diagonal corners. These notches correspond to corners of the center space 23 and form the inlets 8. The bottom plate 60 is provided with a slit 64. When the micro-blower D is mounted on a substrate or the like, the slit 64 serves as a vent for preventing the space under the diaphragm 50 from being enclosed. At the same time, the slit 64 is used for drawing out lead wires of the piezoelectric element 52.

The following data shows results of an experiment for evaluating the micro-blower D having the above-described structure. First, there was prepared a diaphragm formed by attaching a piezoelectric element to a SUS plate 0.1 mm in thickness, the piezoelectric element being composed of a single PZT plate 0.2 mm in thickness and 12.7 mm in diameter. Next, there were prepared a separator, a top plate, a flow path plate, a blower frame, and a bottom plate composed of SUS plates. A second opening 0.6 mm in diameter was provided at the center of the top plate. A first opening 2.0 mm in diameter was provided at the center of the separator. A center space measuring 20 mm long by 20 mm wide was provided in the center of the flow path plate. Next, the above-described components were stacked in the following order: the bottom plate, diaphragm, blower frame, separator, flow path plate, and top plate. They were bonded together to form a blower body measuring 22 mm long by 22 mm wide by 2 mm high. The blower chamber of the blower body was designed to be 0.1 in height and 18 mm in diameter.

When a sine wave voltage of 16-kHz frequency and 60 Vp-p was applied to drive the micro-blower C having the above-described structure, a flow rate of 90 ml/min was achieved at 100 Pa. Although this is an example in which the micro-blower D was driven in the third-order resonance mode, it is also possible to drive the micro-blower D in the first-order resonance mode.

In the present embodiment, since the center space 23 serves as an inflow path for allowing air to flow in all directions about the openings 11 and 31, the resistance of inflow air can be reduced. Moreover, since a substantially entire region of the separator 30 facing the blower chamber is opened by the center space 23, a substantial part of the separator 30 can vibrate with the vibrations of the diaphragm 50. Therefore, even when the diaphragm 50 vibrates in the first-order resonance mode, it is possible to cause the separator 30 to resonate.

In the embodiments described above, a part of the separator (first wall) corresponding to the center space resonates in response to the vibrations of the diaphragm. However, the separator does not necessarily have to resonate. An increase in flow rate can be achieved by any structure in which the separator is excited by vibrations of the diaphragm and vibrates with a predetermined phase delay from the vibrations of the diaphragm.

In the embodiments described above, a plurality of plate members are stacked and bonded together to form a blower body. However, the structure of the blower body is not limited to this. For example, the top plate 10 and the flow path plate 20, the separator 30 and the blower frame 40, and the flow path plate 20 and the separator 30 may be formed of resin or metal as an integral unit.

The shape of inflow paths is not limited to that extending radially and linearly as illustrated in FIG. 5, and any shape can be selected. At the same time, the number of inflow paths is not limited to a particular number, and can be selected in accordance with the flow rate and the level of noise.

The invention claimed is:

1. A piezoelectric micro-blower comprising:

a blower body;

a diaphragm secured to the blower body at a perimeter thereof and including a piezoelectric element;

a first wall attached to the blower body and positioned so as to define a blower chamber between the diaphragm and the first wall, the first wall including a first opening facing a center of the diaphragm, the first opening being in fluid communication with the blower chamber;

a second wall spaced from the first wall and disposed opposite the blower chamber with the first wall interposed between the second wall and the blower chamber, the second wall including a second opening facing the first opening; and an inflow path disposed between the first wall and the second wall, the inflow path including outer ends communicating with the outside of the piezoelectric micro-blower and inner ends connected to the first opening and the second opening; and a center space disposed at the inner ends of the inflow path and having an opening area greater than an opening area of the first opening and an opening area of the second opening; wherein the opening area of the center space is dimensioned such that a portion of the first wall facing the center space resonates in response to displacement of the diaphragm; and the first wall does not include any piezoelectric elements.

2. The piezoelectric micro-blower according to claim 1, wherein the inflow path includes a plurality of paths extending radially from the center space, each path including an outer end provided with an inlet.

3. The piezoelectric micro-blower according to claim 2, wherein the outer end of each path opens on a different surface of the piezoelectric micro-blower than the second opening.

4. The piezoelectric micro-blower according to claim 1, wherein the portion of the first wall facing the center space vibrates with a phase delay of about 90° relative to vibration of the diaphragm.

5. The piezoelectric micro-blower according to claim 1, wherein the piezoelectric element is an annular piezoelectric element including a hollow at a center thereof.

6. The piezoelectric micro-blower according to claim 1, wherein the diaphragm including the piezoelectric element is configured so as to be displaced in a first-order resonance mode or a third-order resonance mode when a voltage is applied to the piezoelectric element.

7. The piezoelectric micro-blower according to claim 1, wherein the blower body includes:

a top plate defining the second wall;

a flow path plate;

a separator defining the first wall;

a blower frame; and a bottom plate.

8. The piezoelectric micro-blower according to claim 7, wherein the diaphragm is secured between the blower frame and the bottom plate.

9. The piezoelectric micro-blower according to claim 7, wherein the flow path plate defines a center space, and the separator, the blower frame, the bottom plate and the diaphragm include notches at respective diagonal corners that form inlets to the center space.

10. The piezoelectric micro-blower according to claim 9, wherein the bottom plate includes a slit.

11. The piezoelectric micro-blower according to claim 1, further comprising an intermediate plate interposed between the diaphragm and the piezoelectric element.

* * * * *